US006311646B1

(12) United States Patent
Selmani

(10) Patent No.: US 6,311,646 B1
(45) Date of Patent: Nov. 6, 2001

(54) HOT WATER HEATER

(76) Inventor: Asllan Selmani, 170 Gower St., Staten Island, NY (US) 10314

( * ) Notice: Subject to any disclaimer, the term of this patent is extended or adjusted under 35 U.S.C. 154(b) by 0 days.

(21) Appl. No.: 09/707,426

(22) Filed: Nov. 7, 2000

(51) Int. Cl.[7] ..... F22B 9/04

(52) U.S. Cl. ..... 122/18.1; 122/18.2; 122/18.3; 122/18.31; 122/155.4; 122/367.3

(58) Field of Search ..... 122/18.1, 18.3, 122/18.31, 117, 46, 48, 155.4, 367.3, 18.4; 137/592; 392/450, 454

(56) References Cited

U.S. PATENT DOCUMENTS

| | | | | |
|---|---|---|---|---|
| 588,300 | | 8/1897 | Verrue . | |
| 909,624 | | 1/1909 | Levering . | |
| 938,623 | | 11/1909 | Allman . | |
| 2,089,734 | * | 8/1937 | Czeschin | 122/18.31 |
| 2,179,496 | * | 11/1939 | Czeschin | 122/18.4 |
| 2,218,422 | * | 10/1940 | Haddock | 122/18.31 |
| 2,499,636 | * | 3/1950 | Finley | 122/18.31 |
| 3,955,556 | * | 5/1976 | Pangborn et al. | 122/18.1 |
| 3,969,153 | | 7/1976 | Suzuki et al. | 148/6.35 |
| 3,987,761 | * | 10/1976 | Downs et al. | 122/367.3 |
| 4,055,152 | * | 10/1977 | Vidalenq | 122/367.3 |
| 4,089,302 | * | 5/1978 | Ensink | 122/367.3 |
| 4,157,706 | * | 6/1979 | Gaskill | 122/367.3 |
| 4,386,500 | | 6/1983 | Sigafoose | 62/79 |
| 4,479,536 | | 10/1984 | Lameris | 165/145 |
| 4,530,347 | | 7/1985 | Baker et al. | 126/360 |
| 4,966,231 | | 10/1990 | Belcher et al. | 165/166 |
| 5,197,456 | * | 3/1993 | Ryno | 122/18.31 |

* cited by examiner

*Primary Examiner*—Jiping Lu
(74) *Attorney, Agent, or Firm*—Goldstein Law Offices, P.C.

(57) ABSTRACT

A hot water heater having a housing with a top chamber, a bottom chamber and a main tank. A cold water inlet pipe runs into the top chamber and extends into the tank. The cold water inlet pipe coils inward, beginning at circumference of the top chamber before extending into the tank, thus increasing the distance the water has to travel inside the heater. Contrastly, the hot water outlet pipe runs straight from the main tank through the top chamber and exits therefrom. The bottom chamber has a dome shaped ceiling with peaked apertures. A burner is positioned along the bottom surface and produces a flame that sends heated air upward, through the peaked apertures into connected heat distribution tubes which travel vertically through the tank. These tubes are angled along their length and have cylindrical fins attached. Once the heat from the flame rises through the apertures, it continues upward through the tubes, until it is released into the top chamber and exits trough an exhaust chimney.

6 Claims, 3 Drawing Sheets

HOT WATER HEATER

BACKGROUND OF THE INVENTION

The invention relates to a hot water heater. More particularly, the invention is an improved hot water heater designed to heat and maintain the water held therein and traveling therethrough to a high temperature, without having to keep a furnace running continuously. Further, the water is heated at a faster rate than in a conventional water heater.

Hot water heaters are used in most homes and commercial buildings in order to supply hot water to the occupants therein. Water that flows into a building through a service line is cold. Pipes connected to the service line carry the water to all the plumbing fixtures and to the appliances that use cold water. One of the pipes also brings water to the hot-water heater, which enters the heater through a cold-water inlet pipe. The water is typically heated in a tank to a temperature of 120° F. to 150° F. (49° C. to 66° C.) and then drawn from the top of the tank. It exits the tank through a hot-water outlet pipe and is carried by branch pipes to the plumbing fixtures and appliances in the building that use hot water.

The hot water heater tank in most homes holds from 30 to 50 gallons of water and is always full. As hot water is used, cold water enters the tank at the bottom to be heated. A furnace, located at the bottom of the heater, ignites a flame that heats the water which is fed through one pipe extending through the center of the tank. Because of this construction, the recovery rate is slow. Accordingly, hot water is not always available to the user. Thus, there exists a need for a hot water heater which may speed up the heating rate of the water contained therein to ensure a reliable hot water supply, while maintaining a higher temperature level without having to keep the furnace running constantly.

U.S. Pat. No. 588,300 to Verrue discloses a water heater comprising a plurality of reservoirs located within single housing. As the water enters the heater, each reservoir must be completely filled before the water begins to enter the next reservoir. This configuration seeks to retard the flow of water within the heater in order to allow it to be exposed to the heat for a longer period of time.

U.S. Pat. No. 909,624 to Levering discloses a gas stove and hot water heater that is constructed to allow a user to easily transport the same and attach the heater to any water supply.

U.S. Pat. No. 938,623 to Allman shows a water heater having a plurality of chambers that hold the fresh water, as well as the boiling water. Heating gases are circulated around the chambers in order to heat the water. This construction seeks to separate and protect the water from contamination that may be caused by contact with injurious gases or polluted air.

U.S. Pat. No. 3,969,153 to Suzuki et al. discloses a method of manufacturing a stainless steel boiler tube with an anticorrosive coating.

U.S. Pat. No. 4,386,500 to Sigafoose shows a water heater heat exchange apparatus kit, and method of installation. This configuration extracts the heat that normally would be wasted and utilizes same to heat water passing thereby.

U.S. Pat. No. 4,479,536 to Lameris discloses a heat exchanger for a gaseous and a liquid medium.

While these units may be suitable for the particular purpose employed, or for general use, they would not be as suitable for the purposes of the present invention as disclosed hereafter.

SUMMARY OF THE INVENTION

In view of the foregoing disadvantages inherent in the known types of water heaters now present in the prior art, the present invention provides an improved hot water heater. As such, the general purpose of the present invention, which will be described subsequently in greater detail, is to provide a new and improved hot water heater which has all the advantages of the prior art and none of the disadvantages.

To attain this, the present invention essentially comprises a hot water heater having a housing with a top chamber, a bottom chamber and a main tank. A cold water inlet pipe runs into the top chamber and extends into the tank. The cold water inlet pipe coils inward, beginning at circumference of the top chamber before extending into the tank, thus increasing the distance the water has to travel inside the heater. Contrastly, the hot water outlet pipe runs straight from the main tank through the top chamber and exits therefrom. The bottom chamber has a dome shaped ceiling with peaked apertures. A burner is positioned along the bottom surface and produces a flame that sends heated air upward, through the peaked apertures into connected heat distribution tubes which travel vertically through the tank. These tubes are angled along their length and have cylindrical fins attached. Once the heat from the flame rises through the apertures, it continues upward through the tubes, until it is released into the top chamber and exits trough an exhaust chimney.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended thereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important therefore, that the claims be regarded as including such equivalent constructions insofar as they do not depart from the spirit and scope of the present invention.

It is therefore an object of the present invention to provide a new and improved hot water heater which has all the advantages of the prior art and none of the disadvantages.

It is another object of the present invention to provide a new and improved hot water heater which may be easily and efficiently manufactured and marketed.

It is a further object of the present invention to provide a new and improved hot water heater which is of durable and reliable construction.

An even further object of the present invention is to provide a new and improved hot water heater which is susceptible to a low cost of manufacture with regard to both materials and labor, and which accordingly is then susceptible to low prices of sale to the consuming public, thereby making such hot water heaters economically available to the buying public.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
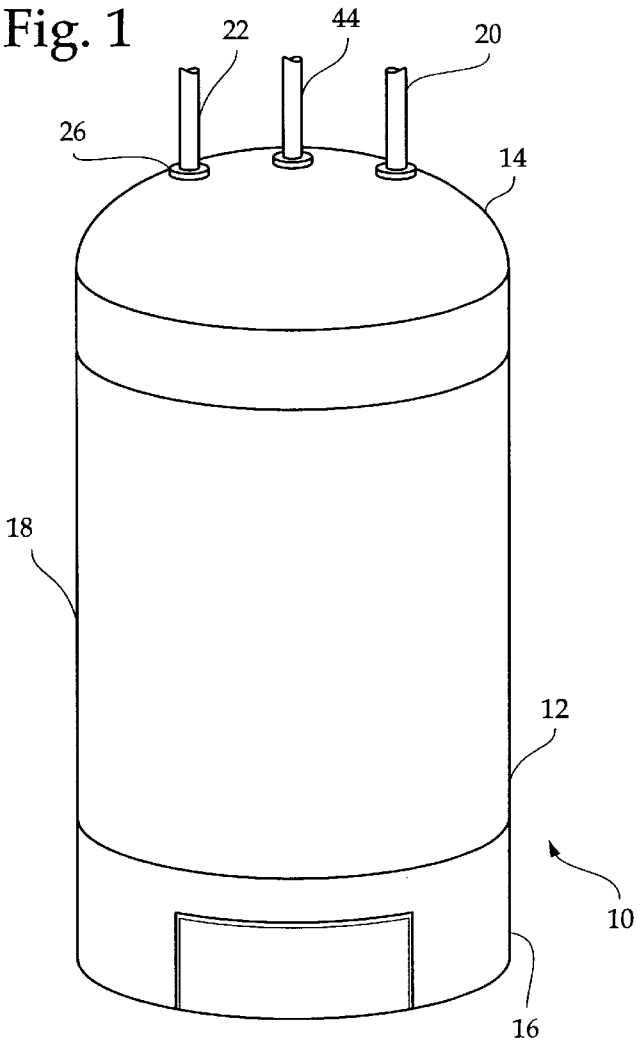
FIG. 1 is a perspective view of the hot water heater.

FIG. 1 illustrates a hot water heater 10 generally comprising a housing 12, containing a top chamber 14, a bottom chamber 16, and a main tank 18 therebetween. A cold water inlet pipe 20 originates outside the housing, extends into the top chamber 14 and then extends into the main tank 18. A hot water outlet pipe 22 originates at the top of the main tank 18, travels through the top chamber 14, and exits therefrom. A chimney 44 is in communication with the top chamber 14.

Figure 2:
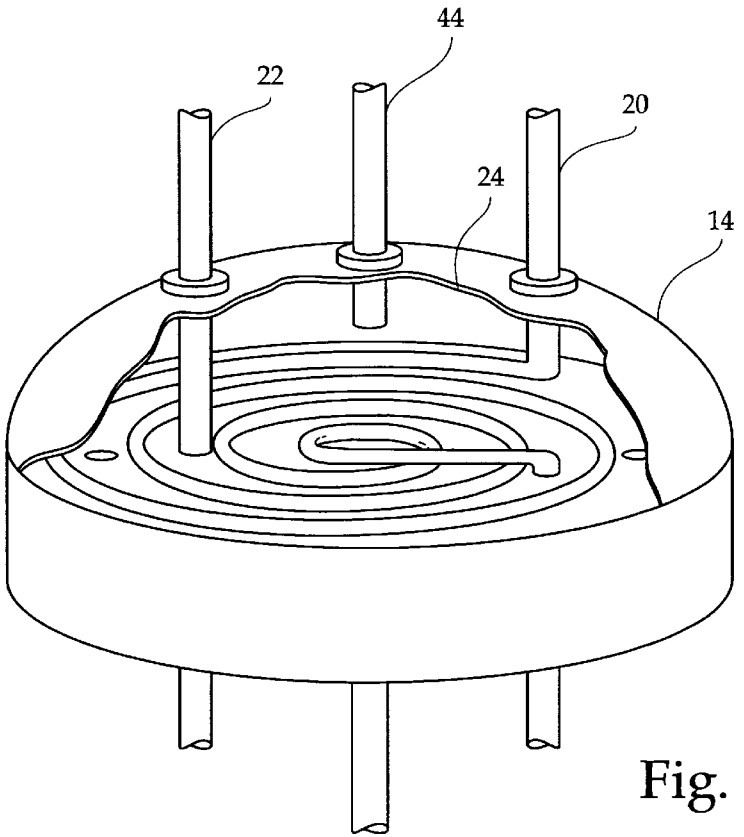
FIG. 2 is a perspective view of just the top chamber of the hot water heater, with a portion of the outer wall broken away.

The top chamber 14 is dome shaped, with a ceiling 24 extending thereover. Three bores 26 extend through the ceiling 24 and have a diameter large enough to accommodate the cold and hot water pipes 20, 22 and chimney 44. The hot water outlet pipe 22 and the cold water inlet pipe 20 are coupled with the appropriate bores 26 and continue through the top chamber 14 to the tank 18 inside the housing 12. The cold water inlet pipe 20 coils within the top chamber 14, originating at the circumference of the top chamber 14, and continues to coil inwardly before extending into the main tank 18, as illustrated in FIG. 2. This configuration increases the distance the water has to travel inside the heater 10, thereby increasing the exposure of the water to heat within the top chamber 14. The hot water outlet pipe 22 originates in the tank 18, extends straight through the top chamber 14, and exits the housing thereat. The chimney 44 also extends through one of the bores 26, venting waste gases from the water heater 10.

Figure 3:
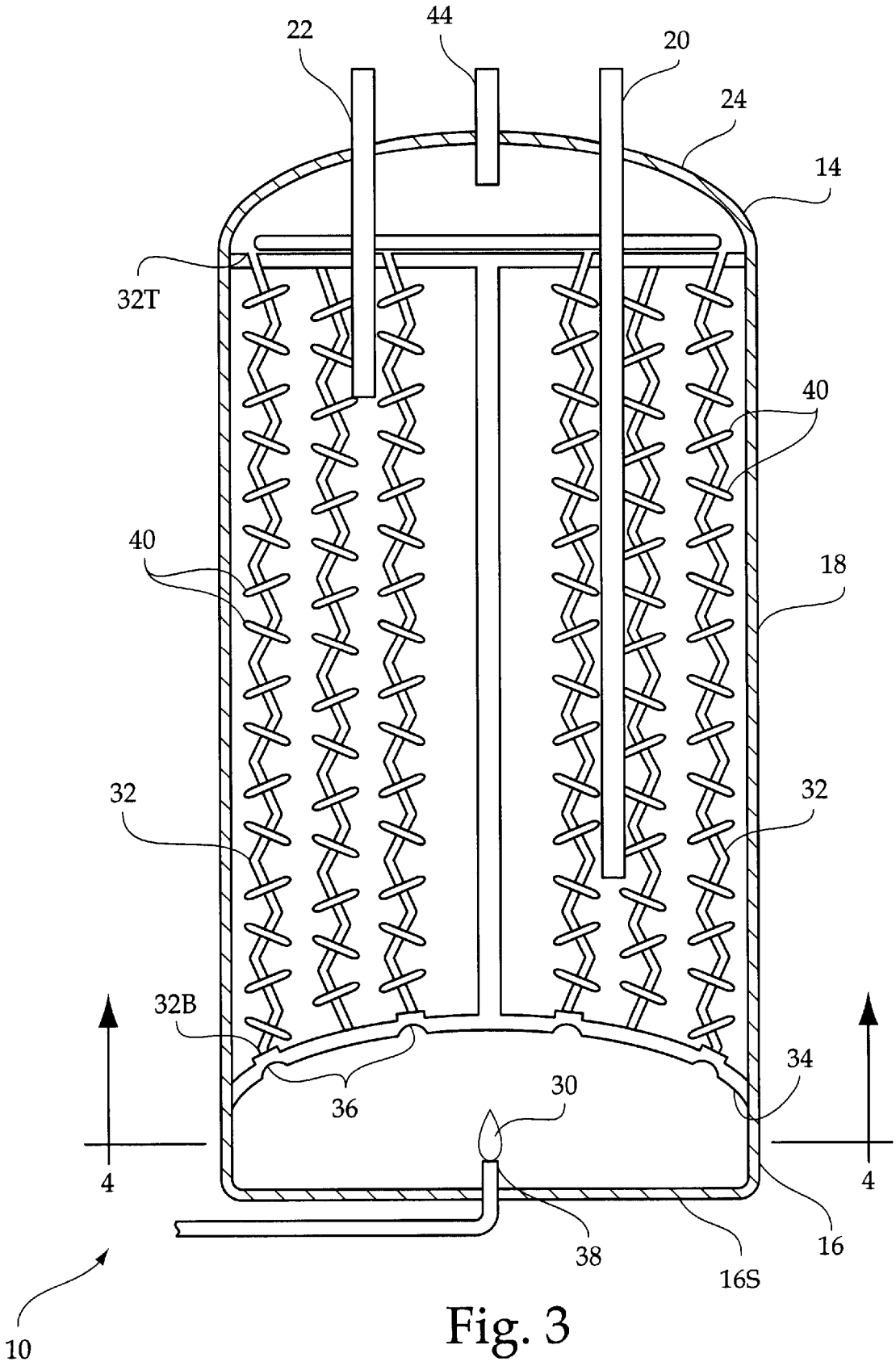
FIG. 3 is a cross sectional view of the water heater.
Figure 4:
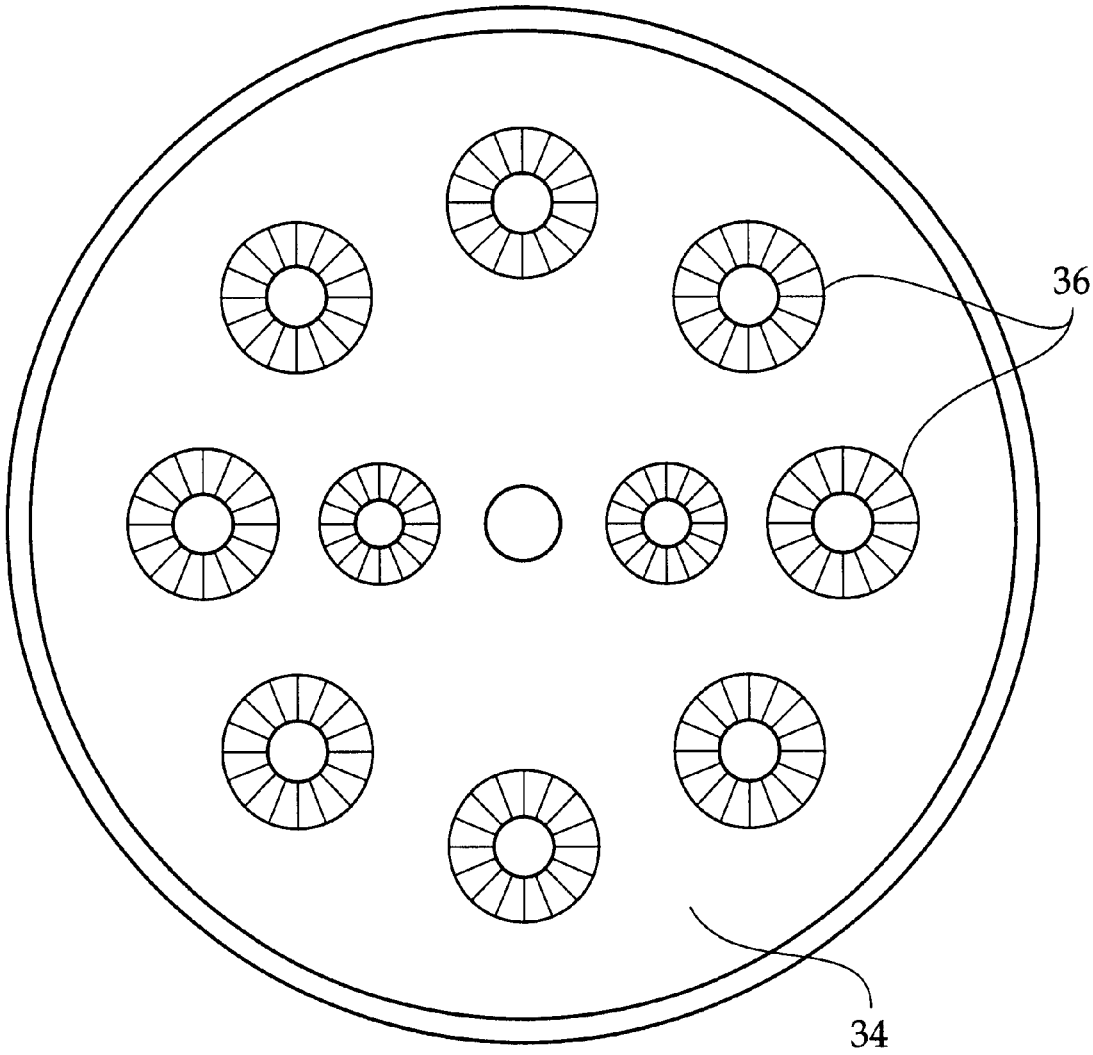
FIG. 4 is taken along line 4—4 of FIG. 3.

Referring to FIG. 3, the bottom chamber 16 also has a dome shaped ceiling 34 and a bottom surface 16S. A plurality of peaked honeycomb apertures 36 are situated on the ceiling 34, as illustrated in FIG. 4. A burner 38 is positioned along the bottom surface 16S and produces a flame 30 when the heater is activated. This flame 30 heats the air in the bottom chamber which rises towards the peaked apertures 36. The heated air passes through the apertures into the tank 18 in a manner descried hereinafter.

As illustrated in FIG. 3, the tank 18 of the hot water heater 10 contains a plurality of heat distribution tubes 32 that extend vertically between the top chamber 14 and the bottom chamber 16. These tubes 32 have numerous alternating bends along their length, said bends are angled approximately 120 degrees. Numerous disk-shaped fins 40 encircle each of the tubes 32, and are spaced between the top and bottom. The tubes 32 each have a bottom opening 32B which is in communication with the bottom chamber 16 at a corresponding peaked aperture 36 and have a top opening 32T in communication with the top chamber 14. Once the heat from the flame 30 rises through the apertures 36, it rises upward through the tubes 32. The heated air traveling in the tubes is released through these top openings 32T into the top chamber 14. The bends of the tubes 32 serve to trap heated air within said tubes 32 for a longer period of time, before rising to the top. Further, the disk-shaped fins 40 are positioned on the tubes 32 in order to radiate a greater amount of heat. After being released into the top chamber 14, the heated air ultimately escapes from the heater through the chimney 44.

In use, cold water enters the hot water heater 10 through the cold water inlet pipe 20 into the top chamber 14. The water then travels through the coiled section of the pipe 20 and is released into the bottom of the tank 18. Once the burner 38 is lit, and heated air passes from the bottom chamber 16 upward through the peaked apertures 36 into the angled tubes 32, the cold water contained in the tank 18 is thereby exposed to the heat generated from the tubes and fins and the temperature of same rises. Hot water is then drawn out of the tank 18 by means of the hot water outlet pipe 22. All components of the heater 10 are constructed from stainless steel, this material being capable of retaining heat, while withstanding corrosion. Thus, the water housed in the tank 18 is exposed to a greater degree of heat which enables said water to rise in temperature faster. Further, the water is able to stay warmer for a longer period because of the heat generated from the angled tubes.

What is claimed is:

1. A hot water heater comprising:

a top chamber having a bottom surface, a plurality of apertures along said bottom surface, a circumference and a center;

a bottom chamber having a bottom surface and a dome shaped ceiling, with a plurality of apertures along the ceiling;

a main tank for holding a quantity of water positioned between the top chamber and the bottom chamber;

a cold water inlet pipe in communication with the main tank, said pipe coiling inwardly within the top chamber, originating at the circumference of the top chamber and continuing to the center of the top chamber, the coiling configuration exposing the water in the pipe to heated air in the top chamber for an extended duration before entering the main tank;

a hot water outlet pipe extending in communication with the main tank;

a burner positioned on the bottom surface of the bottom chamber for heating air within the bottom chamber; and a plurality of tubes positioned vertically within the tank, between the bottom chamber and the top chamber, each tube in communication with one of the apertures on the bottom surface of the top chamber and with one of the apertures on the ceiling of the bottom chamber, said tubes allowing heated air produced in the bottom chamber to travel upward through the tank, and into the top chamber.

2. The hot water heater as recited in claim 1, wherein the plurality of tubes in the tank have numerous alternating bends along their length in order to retard the flow of heated air from the bottom chamber of the heater to the top chamber, thereby exposing the water in the tank to the heated air for a longer period of time.

3. The hot water heater as recited in claim 2, wherein disk-shaped fins encircle each of the plurality of tubes in the tank, said fins radiating heat from the tubes and exposing the water in the tank to this heat.

4. The hot water heater as recited in claim 3, wherein the apertures positioned on the ceiling of the bottom chamber are peaked in order to direct the heated air upwards into the pipes.

5. The hot water heater as recited in claim 4, wherein the cold water inlet pipe enters the tank through the top chamber for dispensing water into the tank, and the hot water outlet pipe originates in the main tank, travels through the top chamber and exits therefrom.

6. The hot water heater as recited in claim 5, wherein the hot water heater is constructed from stainless steel.

* * * * *